US007379864B2

(12) United States Patent
Lee et al.

(10) Patent No.: US 7,379,864 B2
(45) Date of Patent: May 27, 2008

(54) METHOD AND APPARATUS FOR THE DETECTION OF PREVIOUS PACKET LOSS IN NON-PACKETIZED SPEECH

(75) Inventors: Minkyu Lee, Ringoes, NJ (US); James William McGowan, Whitehouse Station, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 987 days.

(21) Appl. No.: 10/430,120

(22) Filed: May 6, 2003

(65) Prior Publication Data

US 2004/0225492 A1 Nov. 11, 2004

(51) Int. Cl.
*G10L 19/14* (2006.01)

(52) U.S. Cl. ..... 704/205; 707/206; 707/208; 455/226.1; 455/226.2; 455/226.3; 370/216; 370/242

(58) Field of Classification Search ..... 704/205, 704/212, 206, 208; 455/226.1–226.3, 229; 370/216, 242
See application file for complete search history.

(56) References Cited

U.S. PATENT DOCUMENTS

| | | | | |
|---|---|---|---|---|
| 5,550,543 A | | 8/1996 | Chen et al. | 341/94 |
| 5,615,298 A | | 3/1997 | Chen | 395/2.37 |
| 5,650,993 A | * | 7/1997 | Lakshman et al. | 370/236 |
| 5,699,385 A | * | 12/1997 | D'Sylva et al. | 375/344 |
| 6,341,145 B1 | * | 1/2002 | Hioe et al. | 375/256 |
| 6,370,120 B1 | * | 4/2002 | Hardy | 370/252 |
| 7,050,400 B1 | * | 5/2006 | Chen et al. | 370/250 |
| 2003/0163304 A1 | * | 8/2003 | Mekuria et al. | 704/207 |
| 2004/0088742 A1 | * | 5/2004 | LeBlanc et al. | 725/149 |

OTHER PUBLICATIONS

Smith, Steven, "the scientist and engineer's guide to digital signal processing", ISBN 0-9660176-3-3, 1997, pp. 275-276).*
U.S. Appl. No. 09/347,462, filed Jul. 6, 1999, McGowan, "Lost-Packet Replacement For A Digital Voice Signal" .
U.S. Appl. No. 09/526,690, filed Mar. 15, 2000, McGowan, "Lost-Packet Replacement For Voice Applications Over Packet Network".
U.S. Appl. No. 09/773,799, filed Feb. 1, 2001, McGowan, "The Burst Ratio: A Measure Of Bursty Loss On Packet Based Networks".
U.S. Appl. No. 10/322,331, filed Dec. 18, 2002, McGowan, "Method And Apparatus For Providing Coder Independent Packet Replacement".

(Continued)

*Primary Examiner*—Richemond Dorvil
*Assistant Examiner*—Qi Han
(74) *Attorney, Agent, or Firm*—Kenneth M. Brown

(57) ABSTRACT

A method and apparatus for detecting previous packet loss in non-packetized speech by applying one or more filters to a segment of said non-packetized speech, each of said one or more filters determining an energy parameter value for a given frequency band of said segment of said non-packetized speech; comparing one or more of said determined energy parameter values to one or more corresponding thresholds; and detecting previous packet loss based on said comparison of said one or more of said determined energy parameter values to said one or more of said corresponding thresholds.

18 Claims, 3 Drawing Sheets

OTHER PUBLICATIONS

U.S. Appl. No. 10/394,118, filed Mar. 21, 2003, M. Lee, "Low-Complexity Packet Loss Concealment Method For Voice-Over-IP Speech Transmission".

ITU-T Recommendation G.711 Appendix II (2000), A high quality low-complexity algorithm for packet loss concealment with G.711.

ITU-T Recommendation G.711 Appendix I (1999), "A Comfort noise payload definition for ITU-T G.711 use in packet-based multimedia communication systems."

ITU-T Recommendation p. 800 (1996), "Methods for subjective determination of transmission quality."

* cited by examiner

METHOD AND APPARATUS FOR THE DETECTION OF PREVIOUS PACKET LOSS IN NON-PACKETIZED SPEECH

FIELD OF THE INVENTION

The present invention relates generally to the field of packet-based communication systems for speech transmission, and more particularly to a method and apparatus for estimating a packet loss rate and packet loss patterns from speech that has been transmitted through an Internet Protocol (IP) network using Voice-over-IP (VoIP) speech coding techniques.

BACKGROUND OF THE INVENTION

When different telecommunications network carriers exchange voice-over-IP traffic—for example, when a Voice-over-IP telephone call is made from a subscriber of a first carrier to a subscriber of a second carrier—the exchange of data is, in accordance with current practice, invariably performed with use of traditional Time Division Multiplexed (TDM) links. Meanwhile, the transmission of Internet Protocol (IP) traffic (i.e., network packets) within a given carrier is commonly performed with use of a packet loss concealment technique which recognizes, and compensates for, the loss of packets (i.e., the failure to receive one or more of the transmitted packets). However, such packet loss concealment techniques are far from perfect, and often introduce audible distortions in the resultant speech.

In addition, it is often necessary for network carriers to guarantee (or at least to be able to measure) a Quality-of-Service (QoS) level to (or for) its customers. In order to be able to do so when VoIP calls have been received from another carrier, it would be highly advantageous for the receiving carrier to be able to identify (e.g., count) the presence of packet losses which occurred in the other carrier's IP network, particularly those that have introduced such audible distortions. However, while Real-time Protocol (RTP) header information is used within an IP packet network to detect lost packets on IP networks, there are currently no methods for detecting whether such packet losses have occurred on speech that is no longer packetized.

Therefore, it would be highly desirable to be able to estimate a packet loss rate and pattern from a speech signal that has been encoded, transmitted through an IP network, decoded with the use of concealed packet loss techniques, and subsequently converted to a non-packetized form (e.g., TDM). In other words, it would be desirable to be able to determine packet loss that has occurred once the speech has been reconstructed and, therefore, lost packet information is no longer available.

SUMMARY OF THE INVENTION

We have recognized that when the packet loss concealment algorithm fails due to packet loss in the IP network, there are distinct spectral features that can be advantageously and reliably detected using certain known signal processing methods. For example, and in accordance with one illustrative embodiment of the present invention, a distinct feature of packet loss in speech which has not been adequately concealed causes a detectable "clicking sound" due to phase and/or amplitude mismatches at the boundaries of lost packets. Recognizing this fact, and in accordance with the one illustrative embodiment of the present invention, these phase/amplitude mismatches may be advantageously detected with use of a conventional filter-bank, or, in the digital domain, a Fast Fourier Transform (FFT) algorithm (which is well known to those of ordinary skill in the art). In particular, voice signals which result from (unsuccessful) packet loss concealment, unlike "clean" voice signals, typically show very high signal energy spread over wide frequency bands.

Note that when packet loss concealment works well, the voice quality at the receiving end is not degraded by the packet loss in the IP network at all (or minimally so). In such a case, the "listener" on the other side of the TDM link would probably not notice any voice quality degradation and it therefore becomes irrelevant (from the perspective of Quality-of-Service) whether packets were lost or not. Therefore, in accordance with the principles of the present invention, the instant invention advantageously estimates not the "actual" packet loss rate (or pattern) in the IP network, but rather, in accordance with the illustrative embodiments thereof, advantageously estimates the rate and pattern of packet loss that has not been adequately concealed by the concealment algorithms. This is the loss that actually affects the voice quality.

Thus, the present invention provides a method and apparatus for detecting previous packet loss in non-packetized speech by applying one or more filters to a segment of said non-packetized speech, each of said one or more filters determining an energy parameter value for a given frequency band of said segment of said non-packetized speech; comparing one or more of said determined energy parameter values to one or more corresponding thresholds; and detecting previous packet loss based on said comparison of said one or more of said determined energy parameter values to said one or more of said corresponding thresholds.

BRIEF DESCRIPTION OF THE DRAWINGS

FIG. 3 shows an illustrative example of spectral distortion which results from packet loss in an IP network.

DETAILED DESCRIPTION

Figure 1:
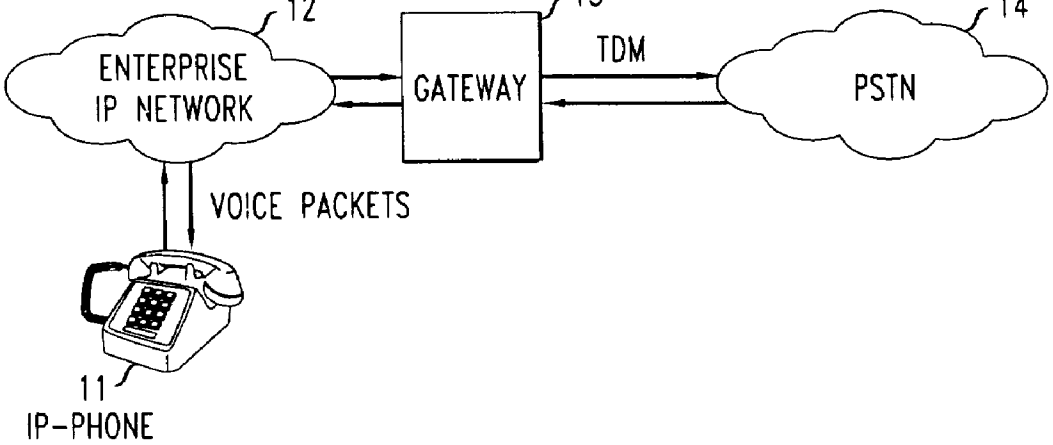
FIG. 1 shows an illustrative block diagram of a voice-over-IP network configuration in which an enterprise IP network is connected to a public switched telephone network through a gateway.

FIG. 1 shows an illustrative block diagram of a voice-over-IP network configuration in which an enterprise IP network is connected to a public switched telephone network through a gateway. Voice data, illustratively generated by IP-phone 11 can be encoded by any one of a number of various conventional speech coding algorithms, such as, for example, G.711, G.723.1, or G.729A, each of which is fully familiar to those of ordinary skill in the art. Encoded voice frames may be advantageously generated as a sequence of voice packets which are transmitted through Enterprise IP network 12 and decoded in gateway 13, from which the voice is illustratively transmitted to Public Switched Telephone Network (PSTN) 14.

Since voice traffic is advantageously transmitted in real-time (for use in real-time communication), voice packets are commonly handled using the UDP/IP protocol (fully familiar to those of ordinary skill in the art), which does not provide for re-sending packets when packets are lost. Rather, when a packet is lost in the IP network, a speech decoder in gateway 13 advantageously conceals the lost packet with use of conventional signal processing techniques. For example, speech coding protocols G.723.1 and G.729 have built-in packet loss concealment schemes, and protocol G.711 recently added an appendix suggesting a specific packet loss concealment method. After performing packet loss concealment (where needed), the output speech from gateway 13 is then advantageously converted to a Time Division Multiplexed (TDM) data stream and sent to the destination through PSTN 14. (Note that the above described path can operate in reverse when IP-phone 11 is receiving an IP call from a caller through PSTN 14.)

Figure 2:
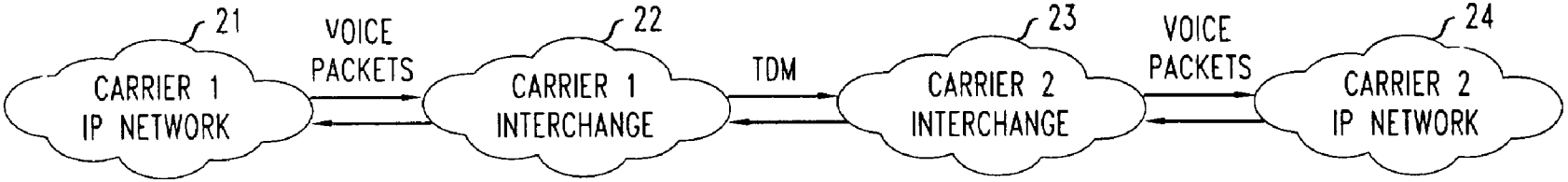
FIG. 2 shows an illustrative block diagram of a carrier-to-carrier voice-over-IP call being exchanged over conventional network equipment.

FIG. 2 shows an illustrative block diagram of a carrier-to-carrier voice-over-IP call being exchanged over conventional network equipment. The block diagram shown in FIG. 2 is an arrangement which is commonly used by most presently existing "tier-one" service providers in the United States. More specifically, voice-over-IP, illustratively emanating as voice packets from IP network 21 belonging to carrier 1, is moved from an IP domain to a TDM signal via interchange 22 (also belonging to carrier 1) for exchange with another service provider (e.g., carrier 2). Similarly, voice-over-IP, illustratively emanating as voice packets from IP network 24 belonging to carrier 2, is moved from an IP domain to a TDM signal via interchange 23 (also belonging to carrier 2) for exchange with another service provider (e.g., carrier 1). Note that due to protocol issues and other practical concerns, essentially all major service providers in the United States currently exchange voice calls over traditional TDM links.

Note that in both FIG. 1 and FIG. 2, a service provider may receive voice from a TDM stream that has previously been subjected to voice quality degradation due to packet loss in another service provider's IP network. In general, packet loss concealment algorithms used in such IP networks work fairly well for low loss rates (e.g., less than a one percent error rate). However, as the packet loss rate increases and, in particular, as the loss pattern becomes bursty, most conventional packet loss concealment algorithms become less able to successfully conceal the audible effects of packet loss. Therefore, for service providers on the receiving side of a TDM link to guarantee (or even estimate) the Quality-of-Service (QoS) being provided to their customers, it is necessary to estimate the packet loss rate in the IP network that is converting the packets to a TDM stream.

In the case of voice-over-IP network configurations such as the configuration illustratively shown in FIG. 1, for example, the gateway most typically routes all calls over a TDM link, even if it happens to be servicing both ends of a conversation. Thus, the TDM signal received by the gateway is often a signal which originated from the gateway itself. (It has been reported that approximately 80% of such calls originate and terminate on the same telecommunications switch.) In this case, therefore, all packet losses occur within the same network, and thus cannot be "blamed" on some other provider feeding the gateway a low quality TDM stream.

In accordance with the principles of the present invention, it is first noted that voice frequencies are limited to a specific "envelope" of frequencies as a result of the microphone (i.e., a transducer which coverts an acoustic signal to an electrical signal), as well as by the nature of the human voice itself. However, phase distortions introduced by most Packet Loss Concealment (PLC) schemes typically appear in the spectrum of the resultant signal as a broadband frequency signal added to the voice signal. In particular, these frequencies have a quantifiable pattern that, in accordance with certain illustrative embodiments of the present invention can be advantageously observed. For example, such PLC schemes commonly introduce relative high energy levels in frequencies on both the low end and the high end of the frequency spectrum that cannot have originated from the original source signal due to the aforementioned frequency "envelope" of a voice signal.

Figure 3A:
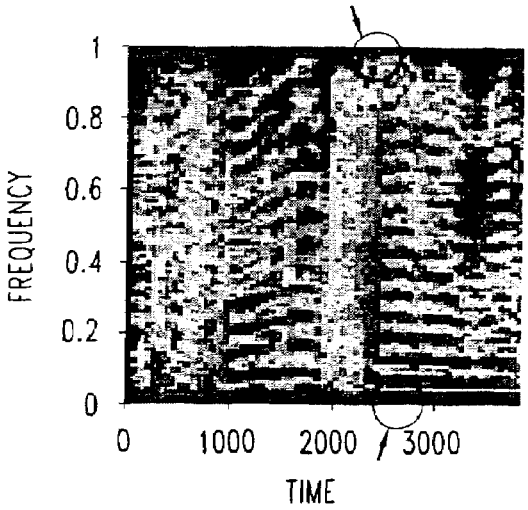
FIG. 3A shows an illustrative spectrogram of original speech.
Figure 3B:
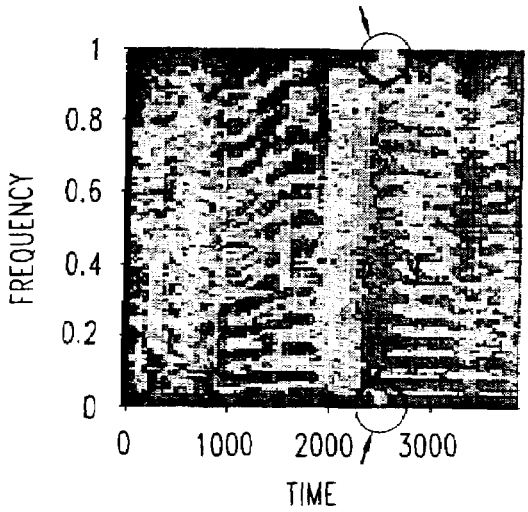
FIG. 3B shows an illustrative spectrogram of a reconstruction of the original speech after a segment of the speech is lost due to an IP network packet loss.

FIG. 3 shows an illustrative example of spectral distortion which results from packet loss in an IP network. FIG. 3A shows an illustrative spectrogram of original speech, and FIG. 3B shows an illustrative spectrogram of a reconstruction of the original speech after a segment of the speech is lost due to an IP network packet loss. Note in particular the spectral distortion that be seen in FIG. 3B as compared to FIG. 3A where indicated. This is the only portion of the speech signal that extends into the lowest and highest frequencies shown. Specifically, the illustrative spectrograms show one second of speech, and the spectrogram of FIG. 3B results from an IP network packet loss of one 20 millisecond segment of the speech, wherein the lost packet was concealed with use of packet repetition, a common packet loss concealment scheme well known to those of ordinary skill in the art.

Therefore, in accordance with one illustrative embodiment of the present invention, these above-described abrupt changes in energy at frequencies outside of the speech band (e.g., those in the low end of the frequency spectrum and in the high end of the frequency spectrum) can be advantageously measured with use of filters specifically tuned to each of these high and low end frequency bands. (For example, conventional low-pass and high-pass filters, familiar to those of ordinary skill in the art, may be used.) Any sharp increase in the output of such filters may be advantageously used to indicate a broadband distortion due to packet loss.

Thus, packet loss may, for example, be identified whenever either the energy level of the high end frequency band exceeds a corresponding threshold or the energy level of the low end frequency band exceeds a corresponding threshold. (In an alternative illustrative embodiment of the present invention, packet loss may be identified whenever both the energy level of the high end frequency band exceeds a corresponding threshold and the energy level of the low end frequency band exceeds a corresponding threshold.) Similarly, packet loss may, for example, be identified whenever either an increase in the energy level of the high end frequency band exceeds a corresponding threshold or an increase in the energy level of the low end frequency band exceeds a corresponding threshold. (And in an alternative illustrative embodiment of the present invention, packet loss may be identified whenever both an increase in the energy level of the high end frequency band exceeds a corresponding threshold and an increase in the energy level of the low end frequency band exceeds a corresponding threshold.)

In accordance with other illustrative embodiments of the present invention, the determination of previous packet loss may be advantageously corroborated by filters tuned to the speech band (e.g., frequencies which are not in either the low end frequency band or the high end frequency band, as described above, but rather, within the speech band itself), which will also show energy with some minimum threshold when a packet has been lost. In other words, and in accordance with such illustrative embodiments of the present invention, packet loss may be identified whenever the energy level in the speech band exceeds a corresponding threshold and when either the energy level (or the increase in the energy level) of the high end frequency band exceeds a corresponding threshold or the energy level (or the increase in the energy level) of the low end frequency band exceeds a corresponding threshold. (Alternatively, packet loss may be identified whenever the energy level in the speech band exceeds a corresponding threshold and both the energy level or the increase in the energy level of the high end frequency band exceeds a corresponding threshold and the energy level or the increase in the energy level of the low end frequency band exceeds a corresponding threshold.)

Therefore, in accordance with one illustrative embodiment of the present invention, the following analysis procedure may be advantageously performed to detect a previous packet loss in non-packetized speech:

Step 1: Retrieve the next segment of speech for analysis. This speech segment may be of any convenient duration, such as, for example, one second. (See FIG. 3.)

Step 2: Apply a set of filters measuring the energy in a low frequency band (illustratively, between 0 and 200 Hertz) and the energy in a high frequency band (illustratively, between 3600 and 4000 Hertz for narrowband voice signals; illustratively between 7200 and 8000 Hertz for wideband audio signals).

Step 3: If the EMS (Root Mean Square) value of the filter response in the low frequency band or in the high frequency band has increased less than a corresponding predetermined threshold, return to step 1—no packet loss is identified. The threshold may be advantageously set based upon the particular set of filters used in step 2. For example, for 8 kiloHertz sampled speech with sample values in the range [−1,1], a low-pass minimum order equiripple Finite Tmpulse Response (FIR) filter with an Epass (passband cutoff frequency) of 100 Hz, Fstop (stophand cutoff frequency) of 200 Hz, Apass (passband ripple magnitude) of 50 dB and Astop (stophand attenuation) of 100 dB may be advantageously employed, in which case a threshold RMS change of 0.001 may be advantageously used as the predetermined threshold which corresponds to the low frequency band. Similarly, also for 8 kHz sampled speech, a high-pass minimum order equiripple FIR filter with a stopband cutoff frequency of 3900 Hz, a passband cutoff frequency of 3999 Hz, a passband ripple magnitude of 50 dB and a stophand attenuation of 100 may be advantageously employed, in which case a threshold EMS change of 0.00001 may be advantageously used as the predetermined threshold which corresponds to the high frequency band. (Minimum order equiripple FIR filters are fully flamiliar to those of ordinary skill in the art. Moreover, the parameters Epass, Estop, Apass and Astop, as used in specifying such filters, are also fully understood by those of ordinary skill in the art.

Step 4. If the energy in either the low frequency band or the high frequency band exceeds the corresponding threshold, a packet loss is advantageously identified. (Return to step 1 to continue analysis of the next speech signal segment.)

Figure 4:
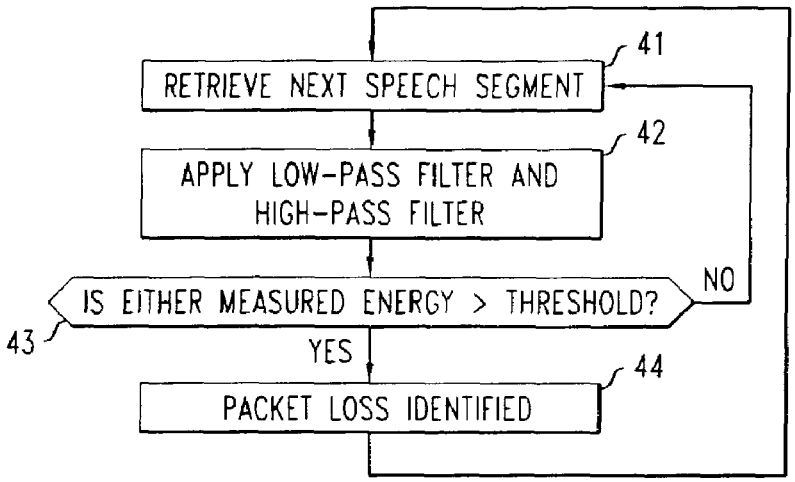
FIG. 4 shows a flow chart of an illustrative method for the detection of previous packet loss in non-packetized speech in accordance with an illustrative embodiment of the present invention.

FIG. 4 shows a flow chart of the above-described illustrative method for the detection of previous packet loss in non-packetized speech in accordance with the illustrative embodiment of the present invention. First, block 41 retrieves the next segment of speech for analysis. Then, block 42 applies filters which measure the energy in a low frequency band and the energy in a high frequency band. Next, decision box 43 compares each of these measured energies to a corresponding threshold, returning to block 41 if neither of the energy levels exceeds the corresponding threshold. If either energy does, in fact, exceed the corresponding threshold, however, flow passes to block 44 which identifies a packet loss in the given speech segment.

Figure 5:
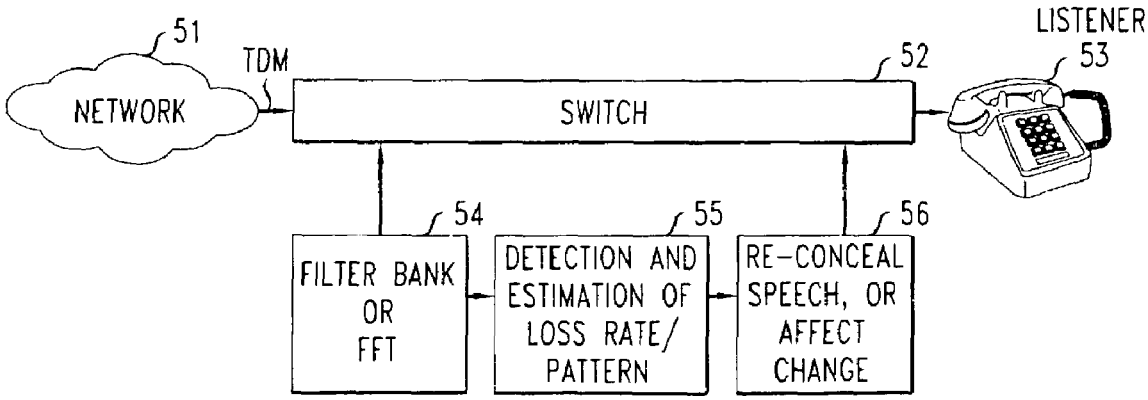
FIG. 5 shows a block diagram of an illustrative apparatus for the detection of previous packet loss in non-packetized speech in accordance with an illustrative embodiment of the present invention.

FIG. 5 shows a block diagram of an illustrative apparatus for the detection of previous packet loss in non-packetized speech in accordance with an illustrative embodiment of the present invention. As shown in the figure, a voice signal which may have been subjected to previous packet loss and/or packet loss concealment is received from network 51 at switch 52. Switch 52 may illustratively be any voice-bearing switch that receives a TDM signal, such as a voice gateway or a conventional telecommunications carrier's circuit switch. Ultimately, switch 52 will provide a resultant voice signal to the listener at telephone 53.

In accordance with the illustrative embodiment of the present invention, switch 52 performs the operations shown in boxes 54, 55 and 56. In particular, as shown in box 54, the switch applies a filter bank or a Fast Fourier Transform (FFT) to the voice signal received from network 51. Then, as shown in box 55, the detection of inadequately concealed packet loss is performed. And finally, if packet loss is detected, box 56 may respond to the identification of the packet loss in any of a number of ways. For example, the loss can be used to change network behavior (such as re-concealing the loss by a better method), or to indicate that the local network (e.g., switch 52) is not responsible for poor voice quality due to packet loss.

Addendum to the Detailed Description

It should be noted that all of the preceding discussion merely illustrates the general principles of the invention. It will be appreciated that those skilled in the art will be able to devise various other arrangements, which, although not explicitly described or shown herein, embody the principles of the invention, and are included within its spirit and scope.

Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. It is also intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown. Thus, the blocks shown, for example, in such flowcharts may be understood as potentially representing physical elements, which may, for example, be expressed in the instant claims as means for specifying particular functions such as are described in the flowchart blocks. Moreover, such flowchart blocks may also be understood as representing physical signals or stored physical data, which may, for example, be comprised in such aforementioned computer readable medium such as disc or semiconductor storage devices.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

We claim:

1. A method for identifying possible previous packet loss in previously packetized speech based on an analysis of un-packetized speech, the un-packetized speech having been generated from said previously packetized speech, the method comprising the steps of:

applying one or more filters to a segment of said un-packetized speech, each of said one or more filters determining an energy parameter value for a given frequency band of said segment of said un-packetized speech;

comparing one or more of said determined energy parameter values to one or more corresponding thresholds; and identifying said possible previous packet loss based on said comparison of said one or more of said determined energy parameter values to said one or more of said corresponding thresholds, wherein said one or more filters comprises at least a first filter which determines a first energy parameter value in a first frequency band comprising frequencies less than a first predetermined frequency and a second filter which determines a second energy parameter value in a second frequency band comprising frequencies greater than a second predetermined frequency, and wherein said first and second energy parameter values are compared to first and second thresholds, respectively.

2. The method of claim 1 wherein said energy parameter value for said. given frequency band comprises a total signal energy level within said given frequency band.

3. The method of claim 1 wherein said energy parameter value for said given frequency band comprises an amount by which a total signal energy level within said given frequency band has increased from a previous determination thereof.

4. The method of claim 1 wherein said step of identifying said possible previous packet loss comprises identifying said possible previous packet loss when either said first energy parameter value exceeds said first threshold or said second energy parameter value exceeds said second threshold.

5. The method of claim 1 wherein said step of identifying said possible previous packet loss comprises identifying said possible previous packet loss when both said first energy parameter value exceeds said first threshold and said second energy parameter value exceeds said second threshold.

6. The method of claim 1 wherein said one or more filters further comprises a third filter which determines a third energy parameter value in a third frequency band comprising frequencies between said first predetermined frequency and said second predetermined frequency, wherein said third energy parameter value comprises a total signal energy level within said third frequency band, wherein said third parameter value is compared to a third threshold, and wherein said step of identifying said possible previous packet loss comprises identifying said possible previous packet loss when said third energy parameter value exceeds said third threshold and when either said first energy parameter value exceeds said first threshold or said second energy parameter value exceeds said second threshold.

7. The method of claim 1 wherein said one or more filters further comprises a third filter which determines a third energy parameter value in a third frequency band comprising frequencies between said first predetermined frequency and said second predetermined frequency, wherein said third energy parameter value comprises a total signal energy level within said third frequency band, wherein said third parameter value is compared to a third threshold, and wherein said step of identifying said possible previous packet loss comprises identifying said possible previous packet loss when said third energy parameter value exceeds said third threshold and when both said first energy parameter value exceeds said first threshold and said second energy parameter value exceeds said second threshold.

8. The method of claim 1 wherein said first filter comprises a low-pass minimum order equiripple Finite Impulse Response filter and wherein said second filter comprises a high-pass minimum order equiripple Finite Impulse Response filter.

9. The method of claim 1 wherein said un-packetized speech comprises digital data and wherein said one or mare filters comprises a Fast Fourier Transform.

10. An apparatus for identifying possible previous packet loss in previously packetized speech based on an analysis of un-packetized speech, the un-packetized speech having been generated from said previously packetized speech, the apparatus comprising a processor adapted to:

apply one or more filters to a segment of said un-packetized speech, each of said one or more filters determining an energy parameter value for a given frequency band of said segment of said un-packetized speech;

compare one or mare of said determined energy parameter values to one or more corresponding thresholds; and identifying said possible previous packet loss based on said comparison of said one or more of said determined energy parameter values to said one or more of said corresponding thresholds, wherein said one or more filters comprises at least a first filter which determines a first energy parameter value in a first frequency band comprising frequencies less than a first predetermined frequency and a second filter which determines a second energy parameter value in a second frequency band comprising frequencies greater than a second predetermined frequency, and wherein said first and second enemy parameter values are compared to first and second thresholds, respectively.

11. The apparatus of claim 10 wherein said energy parameter value for said given frequency band comprises a total signal energy level within said given frequency band.

12. The apparatus of claim 10 wherein said energy parameter value for said given frequency band comprises an amount by which a total signal energy level within said given frequency band has increased from a previous determination thereof.

13. The apparatus of claim 10 wherein said possible previous packet loss is identified when either said first energy parameter value exceeds said first threshold or said second energy parameter value exceeds said second threshold.

14. The apparatus of claim 10 wherein said possible previous packet loss is identified when both said first energy parameter value exceeds said first threshold and said second energy parameter value exceeds said second threshold.

15. The apparatus of claim 10 wherein said one or more filters further comprises a third filter which determines a third energy parameter value in a third frequency band comprising frequencies between said first predetermined frequency and said second predetermined frequency, wherein said third energy parameter value a comprises a total signal energy level within said third frequency band, wherein said third parameter value is compared to a third threshold, and wherein said possible previous packet loss is identified when said third energy parameter value exceeds said third threshold and when either said first energy parameter value exceeds said first threshold or said second energy parameter value exceeds said second threshold.

16. The apparatus of claim 10 wherein, said one or more filters further comprises a third filter which determines a third energy parameter value in a third frequency band comprising frequencies between said first predetermined frequency and said second predetermined frequency, wherein said third energy parameter value comprises a total signal energy level within said third frequency band, wherein said third parameter value is compared to a third threshold, and wherein said possible previous packet loss is identified when said third energy parameter value exceeds said third threshold and when both said first energy parameter value exceeds said first threshold and said second energy parameter value exceeds said second threshold.

17. The apparatus of claim 10 wherein said first filter comprises a low-pass minimum order equiripple Finite Impulse Response filter and wherein said second filter comprises a high-pass minimum order equiripple Finite Impulse Response filter.

18. The apparatus of claim 10 wherein said un-packetized speech comprises digital data and wherein said one or more tillers comprises a Fast Fourier Transform.

* * * * *